US011217877B2

(12) United States Patent
Islam et al.

(10) Patent No.: US 11,217,877 B2
(45) Date of Patent: Jan. 4, 2022

(54) MANAGING ANTENNA MODULE HEAT AND RF EMISSIONS

(71) Applicant: Motorola Mobility LLC, Chicago, IL (US)

(72) Inventors: Md Rashidul Islam, Glen Ellyn, IL (US); Chiya Saeidi, Chicago, IL (US); Yong-Ho Lim, Kildeer, IL (US); Hugh K. Smith, Palatine, IL (US); Martin Rabindra Pais, North Barrington, IL (US)

(73) Assignee: Motorola Mobility LLC, Chicago, IL (US)

( * ) Notice: Subject to any disclaimer, the term of this patent is extended or adjusted under 35 U.S.C. 154(b) by 8 days.

(21) Appl. No.: 16/751,777

(22) Filed: Jan. 24, 2020

(65) Prior Publication Data

US 2021/0234258 A1 Jul. 29, 2021

(51) Int. Cl.

| | |
|---|---|
| ***H01Q 1/24*** | (2006.01) |
| ***H01Q 21/24*** | (2006.01) |
| ***H01Q 1/22*** | (2006.01) |
| ***H01Q 1/02*** | (2006.01) |

(52) U.S. Cl.

CPC ..... *H01Q 1/243* (2013.01); *H01Q 1/02* (2013.01); *H01Q 1/2283* (2013.01); *H01Q 21/24* (2013.01)

(58) Field of Classification Search

CPC ..... H01Q 1/243; H01Q 1/02; H01Q 1/2283; H01Q 21/24

See application file for complete search history.

(56) References Cited

U.S. PATENT DOCUMENTS

| | | | | |
|---|---|---|---|---|
| 5,132,698 | A | 7/1992 | Swineford | |
| 6,414,644 | B1 | 7/2002 | Desargant et al. | |
| 2004/0027304 | A1 | 2/2004 | Chiang et al. | |
| 2008/0224938 | A1 | 9/2008 | Udagawa et al. | |
| 2015/0194728 | A1 | 7/2015 | Piau et al. | |
| 2018/0151947 | A1 | 5/2018 | Apostolos et al. | |
| 2018/0241121 | A1 | 8/2018 | Mohoric et al. | |
| 2020/0227821 | A1* | 7/2020 | Wu | H01Q 1/243 |

FOREIGN PATENT DOCUMENTS

| | | |
|---|---|---|
| CN | 110112577 | 8/2019 |
| DE | 102006012452 | 10/2010 |
| WO | WO-0169723 | 9/2001 |

OTHER PUBLICATIONS

"Combined Search and Examination Report", GB Application No. GB2100605.1, dated Jun. 22, 2021, 8 pages.

* cited by examiner

*Primary Examiner* — Graham P Smith
(74) *Attorney, Agent, or Firm* — FIG. 1 Patents

(57) ABSTRACT

In aspects of managing antenna module heat and RF emissions, an antenna module includes antenna elements that emit radio frequency (RF) signals for wireless data communication. The antenna module also includes an integrated heat sink to dissipate heat generated by an amplifier on the antenna module, where the heat sink is formed as a metallic component having a surface approximately coplanar with the antenna elements. The antenna module also includes one or more grooves that are formed into the surface of the heat sink, where the one or more grooves are effective to allow the RF signals being emitted from the antenna elements without deformation of a radiation pattern of the RF signals.

23 Claims, 5 Drawing Sheets

MANAGING ANTENNA MODULE HEAT AND RF EMISSIONS

BACKGROUND

Devices such as smart devices, mobile devices (e.g., cellular phones and tablet devices), consumer electronics, and the like can be implemented for use in a wide range of industries and for a variety of different applications. Many of these devices can be configured for cellular communications, which is ever-expanding to include multiple communication bands and modulation schemes, such as GSM/2G, UMTS/3G, and LTE/4G. Additionally, fifth generation (5G) cellular network technology is being implemented to accommodate mmWave (mmW) frequencies, as well as sub-6 GHz frequencies, and provides for faster data downloads and more network reliability.

Antenna configurations in these devices are designed to accommodate multiple transmit and receive antennas to exploit multipath propagation, particularly in the mmNR bands (New Radio frequency range, including frequency bands in the mmWave range between 24-100 GHz). For a 5G multiple-input, multiple-output (MIMO) antenna configuration implemented as a readily installable system-on-chip (SoC), the generated heat load can be extensive, exceeding device component operating temperature ranges, and exceeding user comfort levels for holding and using a device. Generally, these 5G devices are implemented for higher data rates and faster communication performance, and the SoC antenna modules can reach their thermal spec limits in a very short amount of time, causing a need for some form of thermal mitigation or device shutdown.

Notably, these SoC antenna modules are located near the outer periphery of a mobile device to facilitate implementation of the 5G cellular technology and accommodate the mmW frequencies. In conventional devices that may be implemented for 2G, 3G, and/or 4G, the power amplifier, power management component, and other support chipsets are typically mounted directly on the printed circuit board (PCB), and a heat sink along with the PCB can be used to dissipate the heat that is generated by the PCB mounted components. Generally, only the antenna is located near the outer periphery of the external device housing, and the antenna elements generate very little heat. However, in a device implemented to utilize 5G cellular technology, the RF power amplifier and power management component are integrated within the SoC antenna module, which is located near the outer periphery of the external device housing. While this design configuration facilitates radio frequency propagation, this can also lead to localized high temperatures, and poses a significant challenge for thermal management as these are also the locations where a user can come into contact with a very hot surface while holding the device, which is not ideal for overall user experience.

BRIEF DESCRIPTION OF THE DRAWINGS

Implementations of the techniques for managing antenna module heat and RF emissions are described with reference to the following Figures. The same numbers may be used throughout to reference like features and components shown in the Figures.

DETAILED DESCRIPTION

Figure 1:
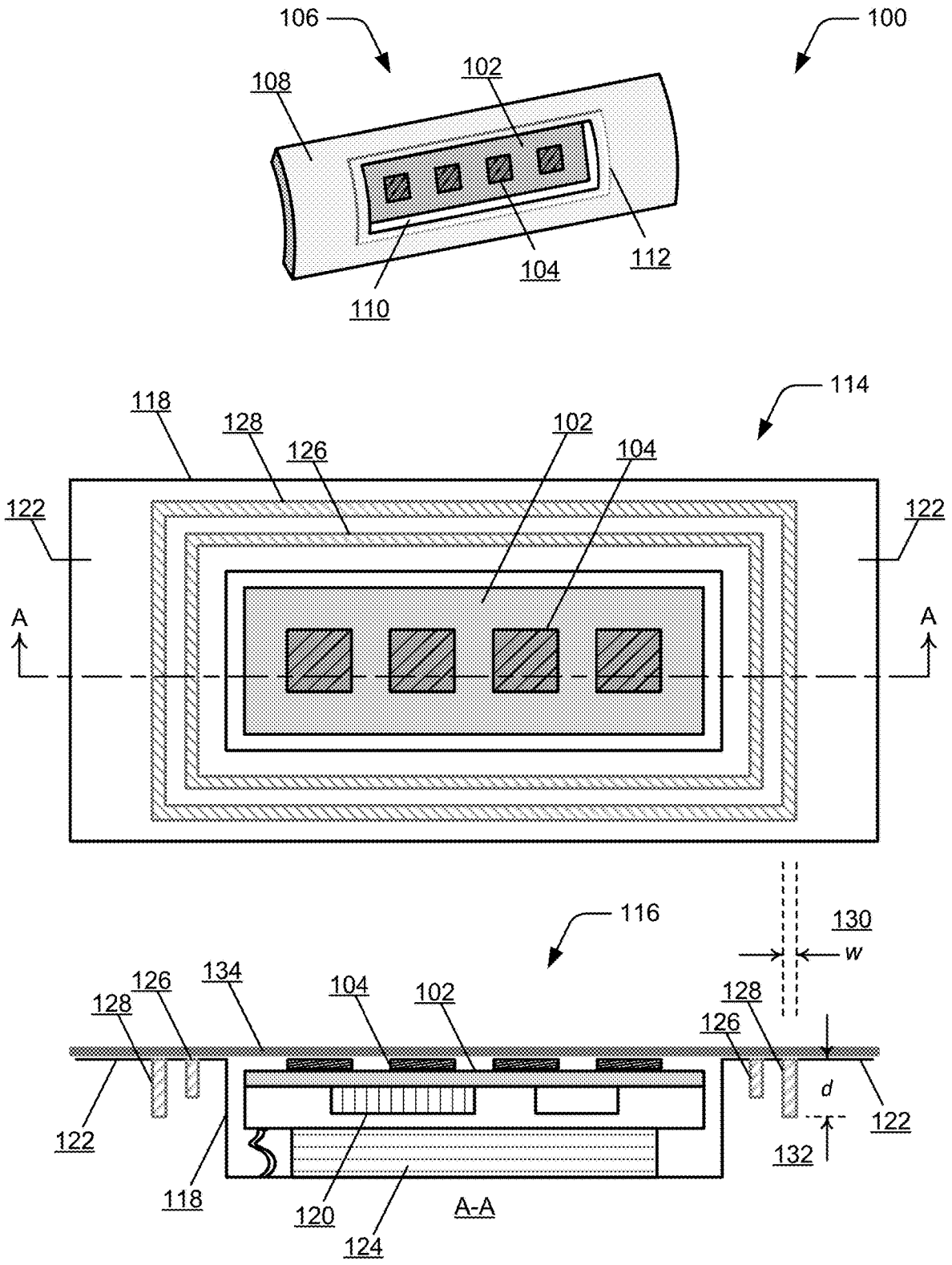
FIG. 1 illustrates an example antenna module in implementations of the techniques described herein for managing antenna module heat and RF emissions.

Implementations of managing antenna module heat and RF emissions are described, and provide techniques to address not only the heat generated by SoC antenna modules implemented in 5G mobile devices, but also to manage and improve the radio frequency (RF) emissions that might otherwise be affected by localized metallic components utilized for the thermal management of the heat generated by the antenna modules. In mobile devices implemented for cellular communication using fifth generation (5G) cellular network technology, the antenna modules are implemented as readily installable system-on-chips (SoC), which include the antenna elements along with a power amplifier and a power management component. Additionally, an antenna module may also include an integrated heat sink designed to dissipate the thermal energy generated by the power amplifier and other module components during operation of the device.

As noted above, the antenna modules implemented in a 5G device are located near the outer periphery of the external device housing, generally as a stand-alone module that is difficult to thermally couple to the rest of the device. Given the placement of the antenna modules within a mobile device, metallic components near an antenna module in the device, as well as structural components that support the external housing of the device, can be used to facilitate heat extraction and dissipation from the antenna module. However, electrically conductive components or features of the device in the vicinity of the antenna module may tend to introduce RF diffraction, induce surface wave creep, and increase coupling with neighboring RF emitters, all of which cause RF loss and reduce the RF efficiencies, in turn demanding higher RF power that leads to increased power dissipation and further depletes device battery power. Accordingly, aspects of managing antenna module heat and RF emissions are implemented to dissipate the heat generated by an antenna module, and also to prevent interference with the emitted radio signals.

In implementations to facilitate higher RF and thermal performance of an SoC antenna module, a heat sink can be integrated with the antenna module, and a surface of the heat sink includes high-impedance groove structures that are designed to allow the mmWave (mmW) RF transmissions being emitted from the antenna elements without deformation of a unidirectional pattern of the RF signals. The groove structures also create a high-impedance surface of the heat sink that minimizes electromagnetic coupling of the RF signals to the surface, creating a "reflective" metallic surface that does not disturb the antenna pattern or affect antenna performance. In the described aspects, an antenna module may also include an integrated heat sink, which can be formed as a metallic component having a surface approximately coplanar with the antenna elements of the antenna module. In alternate implementations, the surface of the heat sink may be angled inward towards the antenna elements effective to beam-shape the pattern of the RF signals emitted from the antenna elements, thus forming a narrower beam pattern. Alternatively, the surface of the heat sink may be angled outward away from the antenna elements effective to allow a wider beam-shaped pattern of the RF signals emitted from the antenna elements.

In aspects of managing antenna module heat and RF emissions as described herein, an antenna module includes antenna elements that emit radio frequency (RF) signals for wireless data communication. Generally, the antenna elements are implemented for millimeter wave (mmW) RF transmission for 5G cellular network communication. The antenna module also includes the integrated heat sink to dissipate heat generated by an amplifier on the antenna module, where the heat sink is formed as a metallic component having a surface approximately coplanar with the antenna elements. The antenna module also includes one or more grooves that are formed into the surface of the heat sink, where the grooves are effective to allow the RF signals being emitted from the antenna elements without deformation of a radiation pattern of the RF signals. The one or more grooves are effective to pass the mmW RF transmissions without deformation of a unidirectional pattern of the RF signals emitted from the antenna elements.

The one or more grooves of the antenna module that are formed into the surface of the heat sink can include parallel grooves having different depths, such as to accommodate different frequencies of the RF signals emitted from the antenna module. The depth of a groove that is formed into the surface of the heat sink corresponds to a quarter-wave impedance of the RF signals emitted from the antenna elements. The one or more grooves formed into the surface of the heat sink create a high-impedance surface that minimizes electromagnetic coupling of the RF signals to the surface. Additionally, the grooves are formed to account for guided wavelengths of the RF signals due to the dielectric constant of a fill material used to aesthetically cover the groove structures in the surface of the heat sink of the antenna module.

In other aspects of managing antenna module heat and RF emissions as described herein, a mobile device, such as a mobile phone or tablet device implemented for wireless data communication, has a device housing with a structural component integrated near an outer periphery of the device housing, and the structural component includes an opening to pass through the radio frequency emissions from the antenna module. The mobile device includes an antenna module, or antenna modules, each with antenna elements that emit radio frequency (RF) signals for wireless data communication, such as for millimeter wave (mmW) RF transmission for 5G cellular network communication. The antenna module is located within the device housing proximate the structural component near the outer periphery of the device housing. The mobile device also has one or more grooves formed into the structural component on at least one side of the opening in the structural component. The grooves are effective to allow the RF signals being emitted from the antenna elements to pass through the opening in the structural component without deformation of a radiation pattern of the RF signals.

The structural component of the device housing in the mobile device is a heat sink proximate the antenna module to dissipate heat generated by an amplifier and other components on the antenna module. Generally, the structural component integrated inside of the device housing is a metallic material that, without the one or more grooves formed into the structural component, would deform the radiation pattern of the RF signals by electromagnetic coupling. However, the grooves are effective to pass the mmW RF transmissions without deformation of a unidirectional pattern of the RF signals emitted from the antenna elements of the antenna module. Further, the grooves formed into the structural component creates a high-impedance surface around the opening in the structural component, and the high-impedance surface minimizes the electromagnetic coupling of the RF signals to the metallic material of the structural component. In a mobile device that includes multiple antenna modules, the grooves formed into the surface of the metallic, structural component create RF isolation between the antenna modules.

While features and concepts of managing antenna module heat and RF emissions can be implemented in any number of different devices, systems, environments, and/or configurations, implementations of managing antenna module heat and RF emissions are described in the context of the following example devices, systems, and methods.

FIG. 1 illustrates an example 100 of an antenna module 102 in implementations of the techniques described herein for managing antenna module heat and RF emissions. In this example 100, the antenna module 102 includes antenna elements 104 that emit radio frequency (RF) signals for wireless data communication. Generally, the antenna elements 104 are implemented for millimeter wave (mmW) RF transmission for 5G cellular network communication. The antenna elements 104 may be implemented in any array configuration, such as in a 1×4 array as shown in FIG. 1, in a 2×4 array of the antenna elements, and the like. As generally shown at 106, the antenna module 102 may be implemented in a mobile phone or tablet device, and the device housing includes a structural component 108 integrated near an outer periphery of the device housing. The structural component 108 may be integrated inside of the device housing for structural integrity of the mobile device exterior housing. An example of a mobile phone device that includes integrated antenna modules for 5G cellular technology is further shown and described with reference to FIG. 2.

The structural component 108 includes an opening 110 to pass through radio frequency emissions from the antenna elements 104 of the antenna module 102. The opening 110 in the structural component is designed so as to limit any impedance of the RF transmissions emitted from the antenna module. The antenna module 102 is located within the device housing proximate the structural component 108 and near the outer periphery of the device housing. The structural component 108 also has one or more grooves 112 that are formed into the structural component on at least one side of the opening 110 in the structural component. The grooves 112 are effective to allow the RF signals being emitted from the antenna elements 104 to pass through the opening 110 in the structural component without deformation of a radiation pattern of the RF signals. In this example shown at 106, the grooves 112 formed into the structural component 108 encompass all four sides of the opening 110 through which the radio frequency transmissions are emitted from the antenna elements 104 of the antenna module 102.

In various implementations, the grooves 112 may surround the opening 110 in the structural component, may run in parallel or orthogonal to the opening, or may be structured on just one, two, or three sides of the opening, taking into account the number of antennas implemented into one antenna module and/or the number of antenna modules collocated in a mobile device. Generally, the grooves can be structured concentric, adjacent, side-by-side, etc. and may be formed in any shape, such as rectangular, oval, radial, and/or in any other configuration layout. The single or multi-groove arrangements can include multiple grooves and of different sizes (i.e., depths and widths) to accommodate antennas that operate in the band of 28-39 GHz, and generally up to 80-100 GHz, in which case different groove sizes and depths accommodate the different wavelengths of the frequencies.

In implementations, the structural component 108 of the device housing in a mobile device performs as a heat sink proximate the antenna module 102 to dissipate heat generated by a power amplifier and other components on the antenna module. Generally, the structural component 108 that is integrated inside of the device housing is a metallic material (e.g., aluminum, copper) that, without the one or more grooves 112 formed into the structural component, would deform the radiation pattern of the RF signals by electromagnetic coupling to the surface of the structural component. However, in this example, the grooves 112 are effective to pass the mmW RF transmissions without deformation of a unidirectional pattern of the RF signals emitted from the antenna elements 104 of the antenna module.

Figure 2:
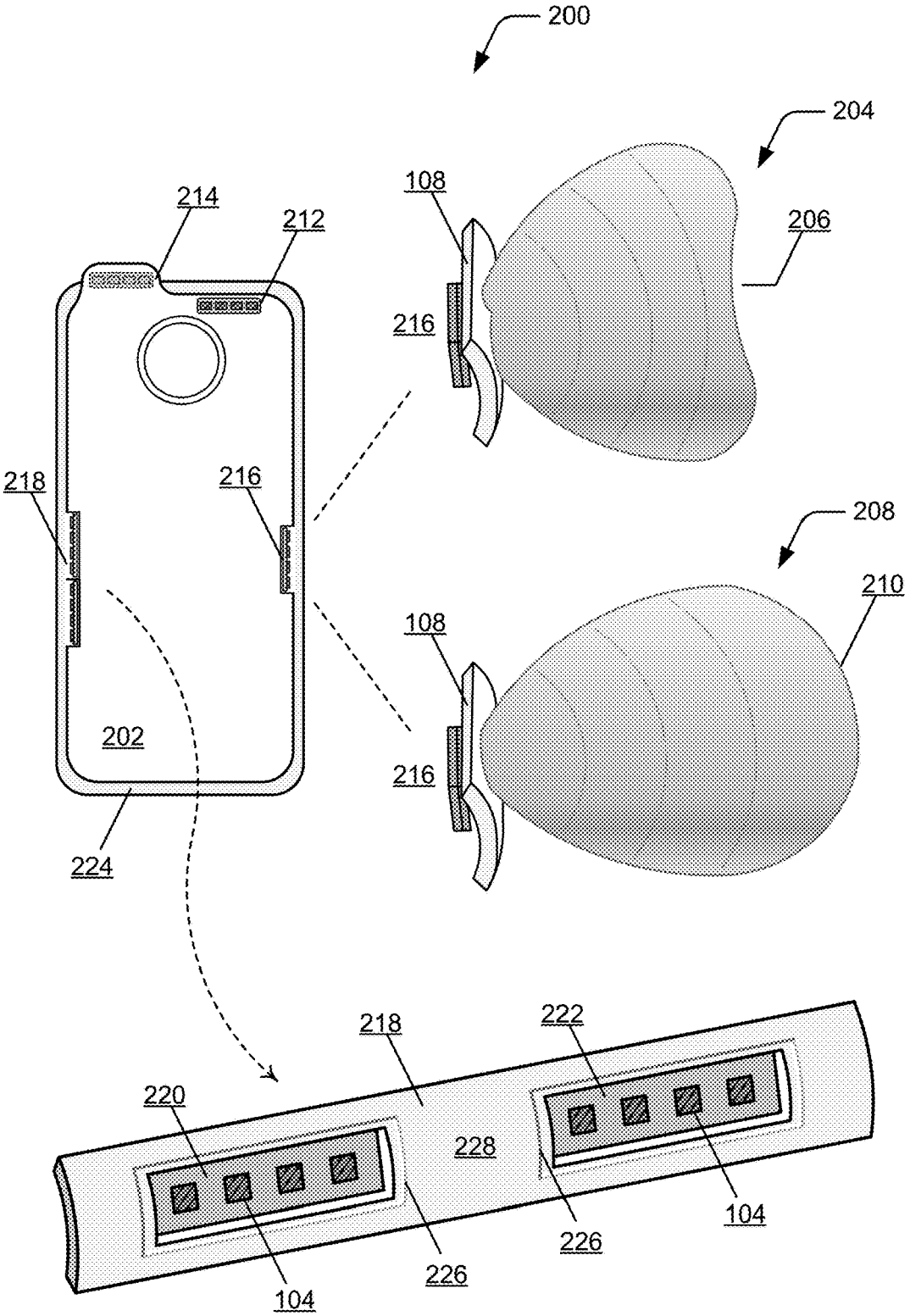
FIG. 2 illustrates an example device that implements antenna modules as described herein for managing antenna module heat and RF emissions.

For example, as shown in FIG. 2, a mobile device 202 is implemented with multiple antenna modules that each include antenna elements that emit a pattern of RF signals. As shown at 204, a structural component 108 without the one or more grooves 112 formed into the structural component would deform the radiation pattern 206 of the RF signals by electromagnetic coupling to the surface of the structural component. However, as shown at 208, the grooves 112 in the structural component 108 are effective to pass through the mmW RF transmissions without deformation of a unidirectional radiation pattern 210 of the RF signals emitted from the antenna elements 104 of the antenna module. Further, the grooves 112 that are formed into the structural component 108 creates a high-impedance surface around the opening 110 in the structural component, and the high-impedance surface minimizes the electromagnetic coupling of the RF signals to the metallic material of the structural component.

In a similar, but alternate implementation of the antenna module 102 shown in FIG. 1 in both a top view 114 and a section view (A-A) 116, the antenna module 102 can include an integrated heat sink 118 to dissipate heat generated by a power amplifier 120 and other components on the antenna module. The heat sink 118 is formed as a metallic component having a surface (or surfaces) 122 that is approximately coplanar with the antenna elements 104 of the antenna module. The antenna module 102 can also include a thermal interface 124 to thermally couple the antenna module 102 to internal components and void spaces of the mobile device, thus facilitating further heat dissipation. The thermal interface 124 functions with the heat sink 118 to dissipate heat energy generated by the power amplifier 120 and other components on the antenna module.

The antenna module 102 also includes one or more grooves 126, 128 that are formed into the surface 122 of the heat sink 118, and the grooves are effective to allow the RF signals being emitted from the antenna elements 104 to pass without deformation of a radiation pattern of the RF signals. The grooves can be interleaved, such as with a high-frequency groove 126 and then a low-frequency groove 128, and as described above, the grooves 126, 128 are effective to pass the mmW RF transmissions without deformation of a unidirectional pattern of the RF signals emitted from the antenna elements. As shown in this example of the top view 114, the grooves 126, 128 of the antenna module 102 that are formed into the surface of the heat sink 118 can include parallel grooves having different depths, such as to accommodate different frequencies of the RF signals being emitted from the antenna module.

For example, the parallel grooves 126, 128 that are formed into the surface on all four sides of the heat sink 118 encompass the antenna module 102, and as shown in the section view 116, each of the grooves has a width 130 and a depth 132. In this example, the groove 128 has a greater depth than the groove 126 into the surface 122 of the heat sink 118. The depth 132 of a groove that is formed into the surface of the heat sink 118 is designed to correspond to a quarter-wave impedance of the RF signals that are emitted from the antenna elements 104 of the antenna module 102. In implementations, the depth 132 of a groove for a particular frequency or range of frequencies (e.g., in the band of 28-39 GHz) is set at $\lambda/4$ or smaller, which is generally a quarter-wave ($\lambda/4$) impedance transformer, and a radio frequency emission will pass over the groove without deformation while also preventing currents from being induced from the antenna elements onto the metallic structure or surface that is proximate the antenna module. Although only two grooves 126, 128 are shown and described in this example 100, any number of grooves may be utilized corresponding to a range of frequencies, such as in the band of 28-39 GHz.

The grooves 126, 128 that are formed into the surface 122 of the heat sink 118 also create a high-impedance surface that minimizes electromagnetic coupling of the RF signals to the surface. Additionally, the structure of the grooves 126, 128 are formed to account for guided wavelengths of the RF signals due to the dielectric constant of a fill material or cover material that may be used to aesthetically cover the grooves in the surface of the heat sink of the antenna module. In this example, and shown in the section view 116, an exterior device housing 134 aesthetically covers the grooves and the antenna modules 102 that are integrated in a mobile device. Generally, the dielectric constant of a fill material or a cover material represents the ability of the material to concentrate electric fields, as related to the ability to store electrical energy in the presence of the RF emissions from the antenna module.

Additionally, the grooves 126, 128 may include a fill or other covering, such as a plastic fill or other material that passes the RF signals. Because the grooves 126, 128 are generally designed to be coplanar with the face of the antenna module 102, which is also at or very near the external surface of the mobile device, the grooves can be painted over or filled with a RF friendly coating that passes the RF signals. However, this coating can also impact the propagation of the electromagnetic waves, in which case the wavelengths are not truly emitted in free-space. Rather, the wavelengths of the emissions are guided wavelengths because the plastic or other fill material over the grooves and openings in the structure needs to be accommodated, and the wavelengths at the 28-39 GHz frequencies are adjusted for the different material compositions (which have different dielectric constants than air). A formula that relates a free-space wavelength to a material that carries an electromagnetic wave is referred to as the guided wavelength, and can be mathematically described as $$\lambda_g \simeq \frac{\lambda_o}{\sqrt{\epsilon\mu}},$$

where the wavelength $\lambda_g$ in a material is derived based on the wavelength $\lambda_o$ in a vacuum.

FIG. 2 illustrates an example 200 of a mobile device 202 that implements multiple antenna modules 102 as described herein for managing antenna module heat and RF emissions. In this example 200, the mobile device 202 may be any type of a computing device, tablet device, mobile phone, flip phone, smart watch, a companion device that may be paired with other mobile devices, and/or any other type of mobile device. Generally, the mobile device 202 may be any type of an electronic and/or computing device implemented with various components, such as a processing system and memory, as well as any number and combination of different components as further described with reference to the example device shown in FIG. 5. For example, the mobile device 202 can include wireless radios that facilitate wireless communications, as well as cellular network communications (e.g., implemented for 5G cellular technology).

In this example 200, the mobile device 202 includes SoC antenna modules 102 on four of the six sides of the device to facilitate 5G coverage, such as rear-facing antenna module 212, a front-facing antenna module 214, a left-facing antenna module 216, and a right-facing antenna module 218. The right-facing antenna module 218 is an example of using multiple integrated antennas in one antenna module. The antenna modules 102 each include the antenna elements 104 that emit the radio frequency (RF) signals for wireless data communication, such as the mmW RF transmissions for 5G cellular network communication.

In this example 200, the right-facing antenna module 218 includes a first antenna module 220 and a second antenna module 222, each with multiple antenna elements 104. The multi-antenna module 218 can be located near structural components 108 of a device housing 224 and/or may include an integrated heat sink 118 that facilitates dissipation of the heat generated by the power amplifiers and other components of the antenna modules. Additionally, the corresponding structural components 108 and/or surfaces of the corresponding heat sink 118 can include the one or more grooves 226 that are formed into the metallic material, effective to allow the RF signals being emitted from the antenna elements 104 without deformation of a radiation pattern of the RF signals. Further, the grooves 226 formed into the structural components 108 and/or into the surfaces of the heat sink 118 create a high-impedance surface 228 that minimizes the electromagnetic coupling of the RF signals to the metallic material, which is also effective to minimize cross-talk and create RF isolation between the antenna modules 220, 222.

As described above, the mobile device 202 has the device housing 224 in which the antenna modules 102 are integrated near an outer periphery of the device housing. The antenna modules 102 can be located near structural components 108 of the device housing that facilitate dissipation of the heat generated by the power amplifiers and other components of the antenna modules. Alternatively or in addition, the antenna modules 102 may include their own integrated heat sink 118 as a readily installable antenna module into a mobile device. Further, the corresponding structural components 108 and/or the surfaces of the corresponding heat sinks 118 include the one or more grooves 112 that are formed into the metallic material, effective to allow the RF signals being emitted from the antenna elements 104 without deformation of a radiation pattern of the RF signals.

As described in the example above, and as shown at 204, a structural component 108 or heat sink 118 without the one or more grooves 112 formed into the structural component or surface of the heat sink would deform the radiation pattern 206 of the RF signals by electromagnetic coupling to the surface of the metallic material. The antenna radiation pattern 206, which is intended to be a unidirectional pattern generated by the antenna array with a maximum gain in an intended direction, is instead disturbed at the mmW frequency and is thus deformed, which reduces the antenna gain and affects the performance of the antenna. However, as shown at 208, the grooves 112 formed into the structural component 108 or into the surface of the heat sink 118 are effective to provide enhanced beam gain and isolation, and allows the mmW RF transmissions without deformation of the unidirectional radiation pattern 210 of the RF signals being emitted from the antenna elements of the antenna modules. This is accomplished with the high-impedance $\lambda/4$ grooves 112 that act as a quarter-wave ($\lambda/4$) impedance transformer.

Figure 3:
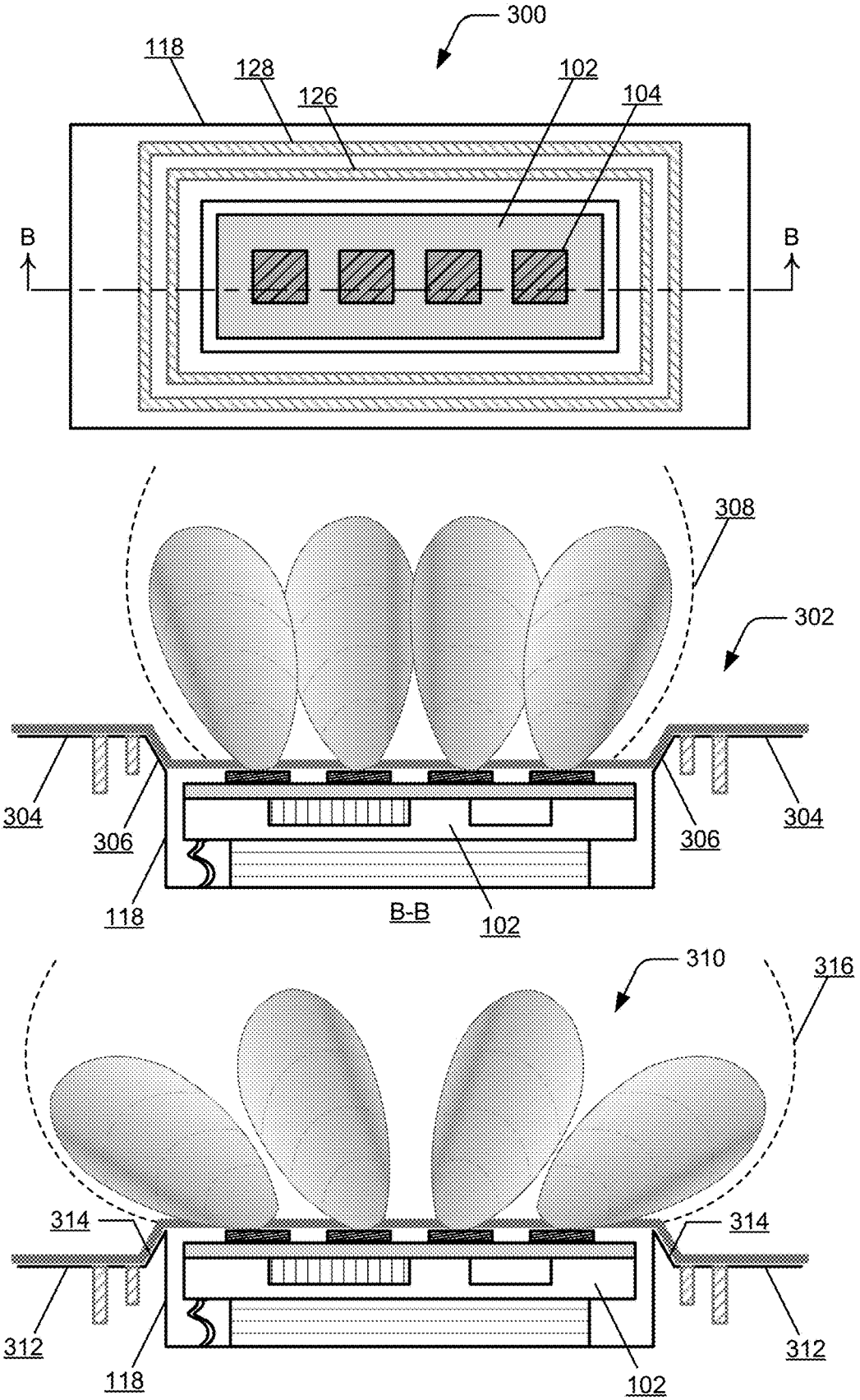
FIG. 3 illustrates alternative implementations of an example antenna module as described herein for managing antenna module heat and RF emissions.

FIG. 3 illustrates examples 300 of alternative implementations of antenna modules as described herein for managing antenna module heat and RF emissions. In this example 300, the antenna module 102 with the antenna elements 104 is included, as shown and described with reference to FIG. 1. As shown in a section view (B-B) 302, the antenna module 102 also includes the integrated heat sink 118 to dissipate the heat generated by the power amplifier and other components on the antenna module. The heat sink 118 is formed as the metallic component having the surfaces 304 that extend in an outwardly direction from the antenna elements 104. As an alternative to having a surface of the heat sink 118 approximately coplanar with the antenna elements 104 of the antenna module 102 (as shown and described with reference to FIG. 1), the surfaces 304 of the heat sink 118 in this example have an angled section 306 of the surface that is angled inward towards the antenna elements 104 (shown on both sides of the SoC antenna module). This performs as a reflector and is effective to beam-shape the pattern of the RF signals being emitted from the antenna elements, and thus form an overall narrower beam pattern 308. Alternatively, and as shown in an alternate section view 310, surfaces 312 of the heat sink 118 have an angled section 314 of the surface that is angled outward away from the antenna elements 104 (shown on both sides of the SoC antenna module). This is effective to allow an overall wider beam-shaped pattern 316 of the RF signals emitted from the antenna elements.

Figure 4:
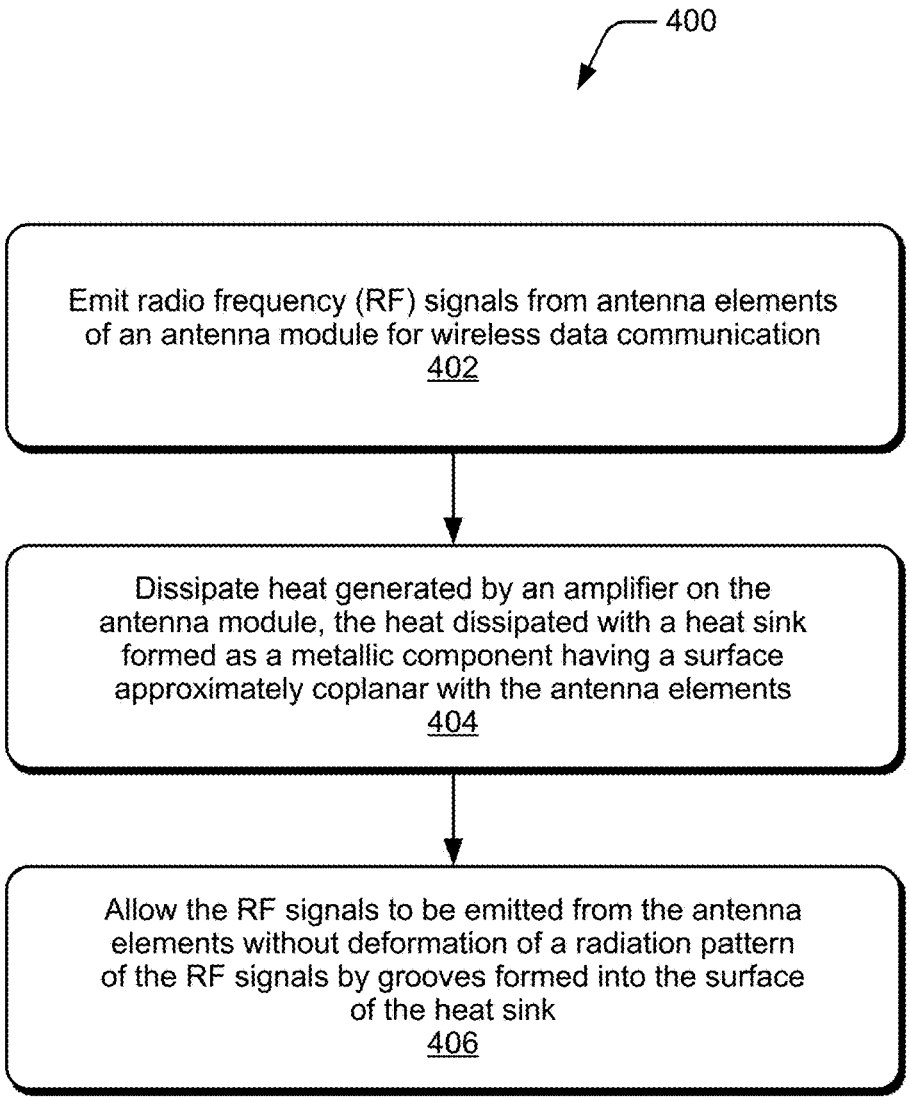
FIG. 4 illustrates an example method of managing antenna module heat and RF emissions in accordance with one or more implementations of the techniques described herein.

FIG. 4 illustrates an example method 400 of managing antenna module heat and RF emissions, and is generally described with reference to an antenna module having antenna elements, at least one amplifier, and an integrated heat sink. The order in which the method is described is not intended to be construed as a limitation, and any number or combination of the described method operations can be performed in any order to perform a method, or an alternate method.

At 402, radio frequency (RF) signals are emitted from antenna elements of an antenna module for wireless data communication. For example, the antenna module 102 includes the antenna elements 104 that emit radio frequency (RF) signals for wireless data communication. Generally, the antenna elements 104 are implemented for millimeter wave (mmW) RF transmission for 5G cellular network communication.

At 404, heat generated by an amplifier on the antenna module is dissipated with a heat sink formed as a metallic component having a surface approximately coplanar with the antenna elements. For example, the antenna module 102 can include the integrated heat sink 118 to dissipate heat generated by the power amplifier 120 and other components on the antenna module. The heat sink 118 is formed as a metallic component having a surface (or surfaces) 122 that is approximately coplanar with the antenna elements 104 of the antenna module. The antenna module 102 can also include a thermal interface 124 to thermally couple the antenna module 102 to internal components and void spaces of the mobile device, thus facilitating further heat dissipation. The thermal interface 124 functions with the heat sink 118 to dissipate heat energy generated by the power amplifier 120 and other components on the antenna module.

At 406, the RF signals are allowed to be emitted from the antenna elements without deformation of a radiation pattern of the RF signals by grooves formed into the surface of the heat sink. For example, the antenna module 102 includes the one or more grooves 126, 128 that are formed into the surface 122 of the heat sink 118, and the grooves are effective to allow the RF signals being emitted from the antenna elements 104 to pass without deformation of a radiation pattern of the RF signals. The grooves 126, 128 of the antenna module 102 that are formed into the surface of the heat sink 118 can include parallel grooves having different depths, such as to accommodate different frequencies of the RF signals being emitted from the antenna module. The depth 132 of a groove that is formed into the surface of the heat sink 118 is designed to correspond to a quarter-wave impedance of the RF signals that are emitted from the antenna elements 104 of the antenna module 102.

In implementations, the depth 132 of a groove for a particular frequency or range of frequencies (e.g., in the band of 28-39 GHz) is set at $\lambda/4$ or smaller, which is generally a quarter-wave ($\lambda/4$) impedance transformer, and a radio frequency emission will pass over the groove without deformation while also preventing currents from being induced from the antenna elements onto the metallic structure or surface that is proximate the antenna module. The grooves 126, 128 that are formed into the surface 122 of the heat sink 118 also create a high-impedance surface that minimizes electromagnetic coupling of the RF signals to the surface. Additionally, the structure of the grooves 126, 128 are formed to account for guided wavelengths of the RF signals due to the dielectric constant of a fill material or cover material that may be used to aesthetically cover the grooves in the surface of the heat sink of the antenna module.

Figure 5:
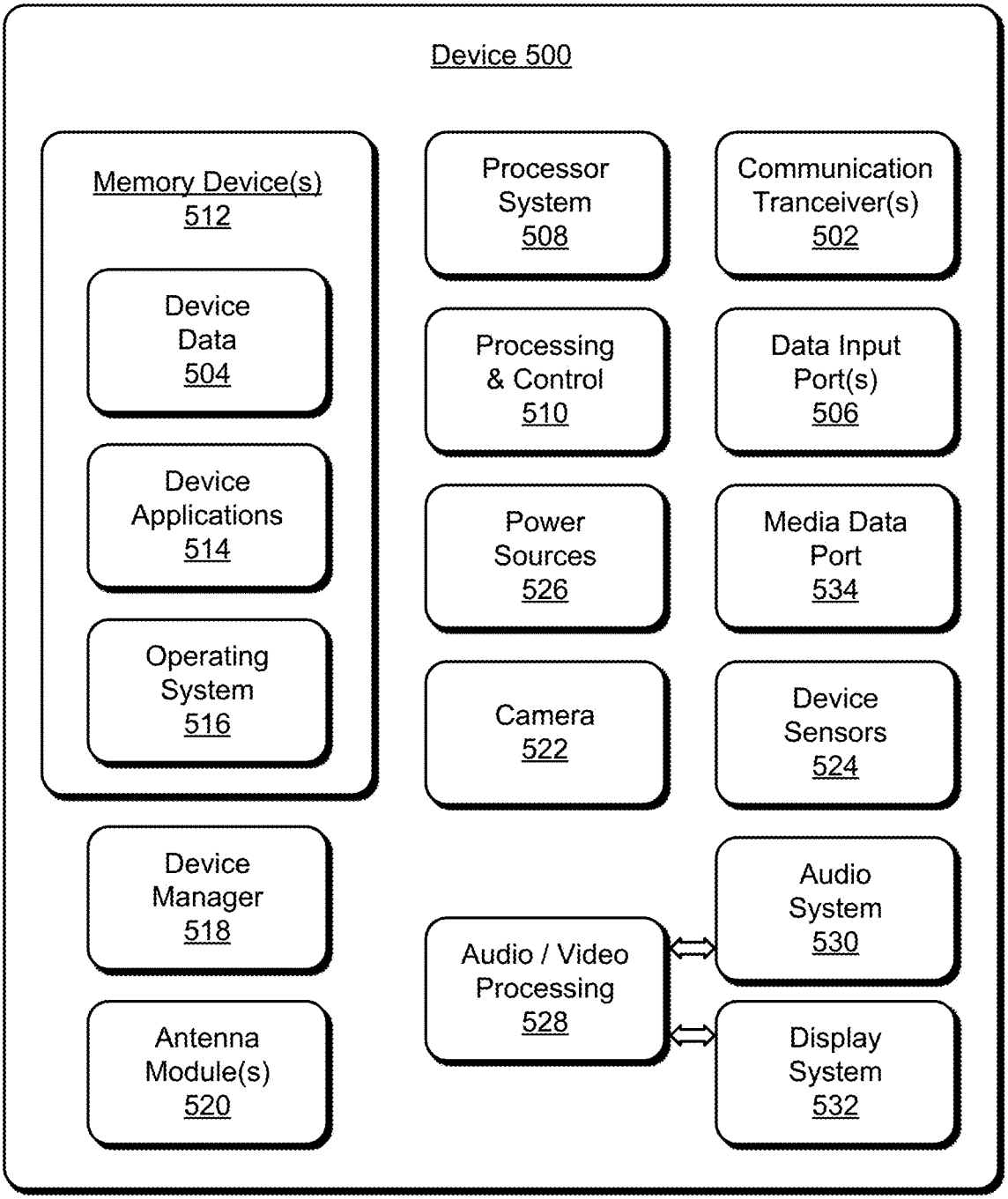
FIG. 5 illustrates various components of an example device that can used to implement the techniques of managing antenna module heat and RF emissions as described herein.

FIG. 5 illustrates various components of an example device 500, in which aspects of managing antenna module heat and RF emissions can be implemented. The example device 500 can be implemented as any of the devices described with reference to the previous FIGS. 1-4, such as any type of a mobile device, mobile phone, flip phone, client device, companion device, paired device, display device, tablet, computing, communication, entertainment, gaming, media playback, and/or any other type of computing and/or electronic device. For example, the mobile device 202 described with reference to FIG. 2 may be implemented as the example device 500.

The device 500 includes communication transceivers 502 that enable wired and/or wireless communication of device data 504 with other devices. The device data 504 can include any type of audio, video, and/or image data. Example communication transceivers 502 include wireless personal area network (WPAN) radios compliant with various IEEE 802.15 (Bluetooth™) standards, wireless local area network (WLAN) radios compliant with any of the various IEEE 802.11 (WiFi™) standards, wireless wide area network (WWAN) radios for cellular phone communication, wireless metropolitan area network (WMAN) radios compliant with various IEEE 802.16 (WiMAX™) standards, and wired local area network (LAN) Ethernet transceivers for network data communication.

The device 500 may also include one or more data input ports 506 via which any type of data, media content, and/or inputs can be received, such as user-selectable inputs to the device, messages, music, television content, recorded content, and any other type of audio, video, and/or image data received from any content and/or data source. The data input ports may include USB ports, coaxial cable ports, and other serial or parallel connectors (including internal connectors) for flash memory, DVDs, CDs, and the like. These data input ports may be used to couple the device to any type of components, peripherals, or accessories such as microphones and/or cameras.

The device 500 includes a processor system 508 of one or more processors (e.g., any of microprocessors, controllers, and the like) and/or a processor and memory system implemented as a system-on-chip (SoC) that processes computer-executable instructions. The processor system may be implemented at least partially in hardware, which can include components of an integrated circuit or on-chip system, an application-specific integrated circuit (ASIC), a field-programmable gate array (FPGA), a complex programmable logic device (CPLD), and other implementations in silicon and/or other hardware. Alternatively or in addition, the device can be implemented with any one or combination of software, hardware, firmware, or fixed logic circuitry that is implemented in connection with processing and control circuits, which are generally identified at 510. The device 500 may further include any type of a system bus or other data and command transfer system that couples the various components within the device. A system bus can include any one or combination of different bus structures and architectures, as well as control and data lines.

The device 500 also includes computer-readable storage memory 512 (e.g., memory devices) that enable data storage, such as data storage devices that can be accessed by a computing device, and that provide persistent storage of data and executable instructions (e.g., software applications, programs, functions, and the like). Examples of the computer-readable storage memory 512 include volatile memory and non-volatile memory, fixed and removable media devices, and any suitable memory device or electronic data storage that maintains data for computing device access. The computer-readable storage memory can include various implementations of random access memory (RAM), read-only memory (ROM), flash memory, and other types of storage media in various memory device configurations. The device 500 may also include a mass storage media device.

The computer-readable storage memory 512 provides data storage mechanisms to store the device data 504, other types of information and/or data, and various device applications 514 (e.g., software applications). For example, an operating system 516 can be maintained as software instructions with a memory device and executed by the processor system 508. The device applications may also include a device manager 518, such as any form of a control application, software application, signal-processing and control module, code that is native to a particular device, a hardware abstraction layer for a particular device, and so on.

In this example, the device 500 includes one or more antenna modules 520 in implementations of managing antenna module heat and RF emissions. Examples of the antenna module 520 include the antenna module 102 described with reference to FIG. 1, the antenna module 218 implemented in the mobile device 202 described with reference to FIG. 2, and the alternate configured antenna modules described with reference to FIG. 3.

In this example, the device 500 also includes a camera 522 and device sensors 524, such as a temperature sensor to monitor device component operating temperatures (to include the antenna modules 520), and device sensors such as may be implemented as components of an inertial measurement unit (IMU). The device sensors 524 can be implemented with various motion sensors, such as a gyroscope, an accelerometer, and/or other types of motion sensors to sense motion of the device. The motion sensors can generate sensor data vectors having three-dimensional parameters (e.g., rotational vectors in x, y, and z-axis coordinates) indicating location, position, acceleration, rotational speed, and/or orientation of the device. The device 500 can also include one or more power sources 526, such as when the device is implemented as a mobile device or collaborative device. The power sources may include a charging and/or power system, and can be implemented as a flexible strip battery, a rechargeable battery, a charged super-capacitor, and/or any other type of active or passive power source.

The device 500 can also include an audio and/or video processing system 528 that generates audio data for an audio system 530 and/or generates display data for a display system 532. The audio system and/or the display system may include any devices that process, display, and/or otherwise render audio, video, display, and/or image data. Display data and audio signals can be communicated to an audio component and/or to a display component via an RF (radio frequency) link, S-video link, HDMI (high-definition multimedia interface), composite video link, component video link, DVI (digital video interface), analog audio connection, or other similar communication link, such as media data port 534. In implementations, the audio system and/or the display system are integrated components of the example device. Alternatively, the audio system and/or the display system are external, peripheral components to the example device.

Although implementations of managing antenna module heat and RF emissions have been described in language specific to features and/or methods, the subject of the appended claims is not necessarily limited to the specific features or methods described. Rather, the specific features and methods are disclosed as example implementations of managing antenna module heat and RF emissions, and other equivalent features and methods are intended to be within the scope of the appended claims. Further, various different examples are described and it is to be appreciated that each described example can be implemented independently or in connection with one or more other described examples. Additional aspects of the techniques, features, and/or methods discussed herein relate to one or more of the following:

An antenna module, comprising: one or more antenna elements that emit radio frequency (RF) signals for wireless data communication; a heat sink to dissipate heat generated by an amplifier on the antenna module, the heat sink formed as a metallic component having at least one surface approximately coplanar with the one or more antenna elements; and one or more grooves formed into the at least one surface of the heat sink, the one or more grooves effective to allow the RF signals being emitted from the one or more antenna elements without deformation of a radiation pattern of the RF signals.

Alternatively or in addition to the above described antenna module, any one or combination of: the one or more grooves include parallel grooves having different depths formed into the at least one surface of the heat sink. The parallel grooves of the different depths formed into the at least one surface of the heat sink accommodate different frequencies of the RF signals emitted from the antenna module. A depth of the one or more grooves formed into the at least one surface of the heat sink corresponds to a quarter-wave impedance of the RF signals emitted from the one or more antenna elements. The one or more grooves formed into the at least one surface of the heat sink account for guided wavelengths of the RF signals due to a dielectric constant of a fill material used to aesthetically cover the one or more grooves. The one or more antenna elements are implemented for millimeter wave (mmW) RF transmission for 5G cellular network communication. The one or more grooves are effective to pass the mmW RF transmission without deformation of a unidirectional pattern of the RF signals emitted from the one or more antenna elements. The one or more grooves formed into the at least one surface of the heat sink creates a high-impedance surface that minimizes electromagnetic coupling of the RF signals to the at least one surface.

A mobile device, comprising: a device housing with a structural component integrated near an outer periphery of the device housing, the structural component including an opening to pass through radio frequency emissions; an antenna module with one or more antenna elements that emit radio frequency (RF) signals for wireless data communication, the antenna module located within the device housing proximate the structural component near the outer periphery of the device housing; and one or more grooves formed into the structural component on at least one side of the opening in the structural component, the one or more grooves effective to allow the RF signals being emitted from the one or more antenna elements through the opening in the structural component without deformation of a radiation pattern of the RF signals.

Alternatively or in addition to the above described mobile device, any one or combination of: the structural component is a heat sink proximate the antenna module to dissipate heat generated by an amplifier on the antenna module. The one or more grooves include parallel grooves having different depths formed into the structural component on the at least one side of the opening in the structural component. The parallel grooves of the different depths formed into the structural component accommodate different frequencies of the RF signals emitted from the antenna module. The antenna module is implemented for millimeter wave (mmW) RF transmission for 5G cellular network communication. The one or more grooves are effective to pass the mmW RF transmission without deformation of a unidirectional pattern of the RF signals emitted from the one or more antenna elements of the antenna module. The structural component integrated inside of the device housing is a metallic material that, without the one or more grooves formed into the structural component, would deform the radiation pattern of the RF signals by electromagnetic coupling. The one or more grooves formed into the structural component creates a high-impedance surface on the least one side of the opening in the structural component, and the high-impedance surface minimizes the electromagnetic coupling. A depth of the one or more grooves formed into the structural component corresponds to a quarter-wave impedance of the radio frequency emissions. The one or more grooves are formed into the structural component around the opening in the structural component are effective to create a high-impedance surface that minimizes electromagnetic coupling of the RF signals to a metallic material of the structural component.

A mobile device, comprising: a device housing with a metallic component integrated inside of the device housing near an outer periphery of the device housing; antenna modules each with one or more antenna elements that emit radio frequency (RF) signals for wireless data communication, the antenna modules located within the device housing proximate the metallic component near the outer periphery of the device housing; and one or more grooves formed into the metallic component, the one or more grooves effective to allow the RF signals being emitted from the one or more antenna elements without deformation of a radiation pattern of the RF signals emitted from the antenna modules.

Alternatively or in addition to the above described mobile device, any one or combination of: the metallic component is a heat sink proximate the antenna modules to dissipate heat generated by amplifiers on the respective antenna modules. The metallic component includes multiple openings to pass through the RF signals emitted from the antenna modules; a surface of the metallic component is approximately coplanar with the one or more antenna elements of the respective antenna modules; and the one or more grooves formed into the surface of the metallic component creates a high-impedance surface that minimizes electromagnetic coupling of the RF signals to the surface of the metallic component. The one or more grooves formed into the surface of the metallic component create RF isolation between the antenna modules. The one or more grooves formed into the metallic component include multiple grooves having different depths that accommodate different frequencies of the RF signals emitted from the antenna modules.

The invention claimed is:

1. An antenna module, comprising:

one or more antenna elements that emit radio frequency (RF) signals for wireless data communication;

a heat sink to dissipate heat generated by an amplifier on the antenna module, the heat sink formed as a metallic component having at least one surface approximately coplanar with the one or more antenna elements; and one or more grooves, including parallel grooves having different depths, formed into the at least one surface of the heat sink.

2. The antenna module as recited in claim 1, wherein the parallel grooves of the different depths formed into the at least one surface of the heat sink accommodate different frequencies of the RF signals emitted from the antenna module.

3. The antenna module as recited in claim 1, wherein a depth of the one or more grooves formed into the at least one surface of the heat sink corresponds to a quarter-wave impedance of the RF signals emitted from the one or more antenna elements.

4. The antenna module as recited in claim 1, wherein the one or more grooves formed into the at least one surface of the heat sink account for guided wavelengths of the RF signals due to a dielectric constant of a fill material used to aesthetically cover the one or more grooves.

5. The antenna module as recited in claim 1, wherein the one or more antenna elements are implemented for millimeter wave (mmW) RF transmission for 5G cellular network communication.

6. The antenna module as recited in claim 5, wherein the one or more grooves are effective to pass the mmW RF transmission without deformation of a unidirectional pattern of the RF signals emitted from the one or more antenna elements.

7. The antenna module as recited in claim 1, wherein the one or more grooves formed into the at least one surface of the heat sink creates a high-impedance surface that minimizes electromagnetic coupling of the RF signals to the at least one surface.

8. A mobile device, comprising:

a device housing with a structural component integrated near an outer periphery of the device housing, the structural component including an opening to pass through radio frequency emissions;

an antenna module with one or more antenna elements that emit radio frequency (RF) signals for wireless data communication, the antenna module located within the device housing proximate the structural component near the outer periphery of the device housing; and one or more grooves formed into the structural component on at least one side of the opening in the structural component, a depth of the one or more grooves corresponding to a quarter-wave impedance of the radio frequency emissions, and the RF signals being emitted from the one or more antenna elements through the opening in the structural component.

9. The mobile device as recited in claim 8, wherein the structural component is a heat sink proximate the antenna module to dissipate heat generated by an amplifier on the antenna module.

10. The mobile device as recited in claim 8, wherein the one or more grooves include parallel grooves having different depths formed into the structural component on the at least one side of the opening in the structural component.

11. The mobile device as recited in claim 10, wherein the parallel grooves of the different depths formed into the structural component accommodate different frequencies of the RF signals emitted from the antenna module.

12. The mobile device as recited in claim 8, wherein the antenna module is implemented for millimeter wave (mmW) RF transmission for 5G cellular network communication.

13. The mobile device as recited in claim 12, wherein the one or more grooves are effective to pass the mmW RF transmission without deformation of a unidirectional pattern of the RF signals emitted from the one or more antenna elements of the antenna module.

14. The mobile device as recited in claim 8, wherein the structural component integrated inside of the device housing is a metallic material that, without the one or more grooves formed into the structural component, would deform the radiation pattern of the RF signals by electromagnetic coupling.

15. The mobile device as recited in claim 14, wherein the one or more grooves formed into the structural component creates a high-impedance surface on the least one side of the opening in the structural component, and the high-impedance surface minimizes the electromagnetic coupling.

16. The mobile device as recited in claim 8, wherein the one or more grooves formed into the structural component around the opening in the structural component are effective to create a high-impedance surface that minimizes electromagnetic coupling of the RF signals to a metallic material of the structural component.

17. A mobile device, comprising:

a device housing with a metallic component integrated inside of the device housing near an outer periphery of the device housing;

antenna modules each with one or more antenna elements that emit radio frequency (RF) signals for wireless data communication, the antenna modules located within the device housing proximate the metallic component near the outer periphery of the device housing; and one or more grooves formed into the metallic component, including multiple grooves having different depths that accommodate different frequencies of the RF signals emitted from the antenna modules.

18. The mobile device as recited in claim 17, wherein the metallic component is a heat sink proximate the antenna modules to dissipate heat generated by amplifiers on the respective antenna modules.

19. The mobile device as recited in claim 17, wherein:

the metallic component includes multiple openings to pass through the RF signals emitted from the antenna modules;

a surface of the metallic component is approximately coplanar with the one or more antenna elements of the respective antenna modules; and the one or more grooves formed into the surface of the metallic component creates a high-impedance surface that minimizes electromagnetic coupling of the RF signals to the surface of the metallic component.

20. The mobile device as recited in claim 19, wherein the one or more grooves formed into the surface of the metallic component create RF isolation between the antenna modules.

21. The antenna module as recited in claim 1, wherein:

the one or more antenna elements emit the RF signals through an opening in the at least one surface of the heat sink; and the one or more grooves are formed into the at least one surface of the heat sink around the opening in the at least one surface.

22. The mobile device as recited in claim 8, wherein the one or more grooves are formed into the structural component around the opening in the structural component.

23. The mobile device as recited in claim 17, wherein:

the metallic component includes at least one opening to pass through the RF signals; and the one or more grooves are formed into the metallic component around the at least one opening in the metallic component.

* * * * *